United States Patent [19]

Tizzi

[11] Patent Number: 4,910,954

[45] Date of Patent: Mar. 27, 1990

[54] APPARATUS FOR THE FORMATION OF ORNAMENTAL CHAINS

[76] Inventor: Valtiero Tizzi, Via Clementini, 2, 47037 Rimini (Forlì), Italy

[21] Appl. No.: 398,287

[22] Filed: Aug. 23, 1989

Related U.S. Application Data

[60] Division of Ser. No. 157,092, Feb. 9, 1988, abandoned, which is a continuation of Ser. No. 809,899, Dec. 17, 1985, abandoned.

[30] Foreign Application Priority Data

Dec. 21, 1984 [IT] Italy ..... 3665 A/84

[51] Int. Cl.[4] ..... B21L 3/00

[52] U.S. Cl. ..... 59/18; 59/22; 59/27; 59/33

[58] Field of Search ..... 59/3, 1, 10, 17, 18, 59/19, 22, 23, 27, 34, 35.1, 16, 33

[56] References Cited

U.S. PATENT DOCUMENTS

| | | | |
|---|---|---|---|
| 233,768 | 10/1880 | Jerome | 59/22 |
| 1,546,393 | 7/1925 | Maisenbacher | 59/18 |
| 1,835,598 | 12/1931 | Hogberg et al. | 59/16 |
| 2,063,593 | 12/1936 | Dieterich et al. | 59/16 |
| 3,913,374 | 10/1975 | Esser et al. | 59/23 |
| 4,275,555 | 6/1981 | Bichi | 59/18 |
| 4,311,003 | 1/1982 | Tega | 59/16 |

FOREIGN PATENT DOCUMENTS

| | | | |
|---|---|---|---|
| 280445 | 11/1913 | Fed. Rep. of Germany | 59/23 |
| 2028266 | 12/1971 | Fed. Rep. of Germany | 59/27 |
| 529221 | 11/1921 | France | 59/16 |
| 88227 | 1/1920 | Switzerland | 59/22 |

*Primary Examiner*—David Jones

*Attorney, Agent, or Firm*—Birch, Stewart, Kolasch & Birch

[57] ABSTRACT

The disclosure relates to the art field of machines for crafting jewelry, namely, chains both in precious metal and in costume jewelry metals. The apparatus of the present invention includes an indexing mechanism for feeding at least one wire, a cutter for severance of the wire into discrete lengths, a horizontal link former that can move transversely relative to the direction the wire is being fed, and a vertical pincer the grips of which are designed to loop the longitudinal member around the entire cross-sectional periphery of the link former in such a way that the ends of a length of wire, formed into a link exceed the peripheral length of the link thus manipulated. The pincer moves through a path parallel to the link former and into a position where soldering means are located that fuse together the end stretched portions of excess length of the link into a bead, thereby embellishing the finished link.

2 Claims, 2 Drawing Sheets

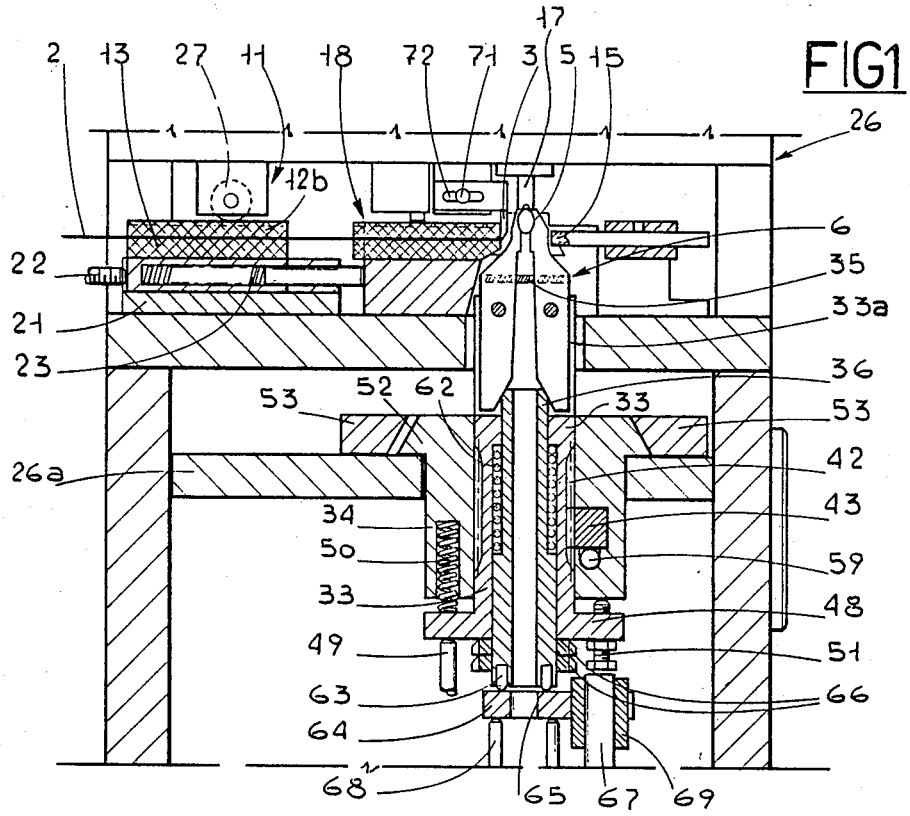
FIG1
2
13
27
11
18
72
71
3
5
15
17
26
12b
6
22
35
21
33a
23
36
53
52
62
33
53
26a
42
34
43
50
59
33
48
49
51
63
66
64
68
65
67
69
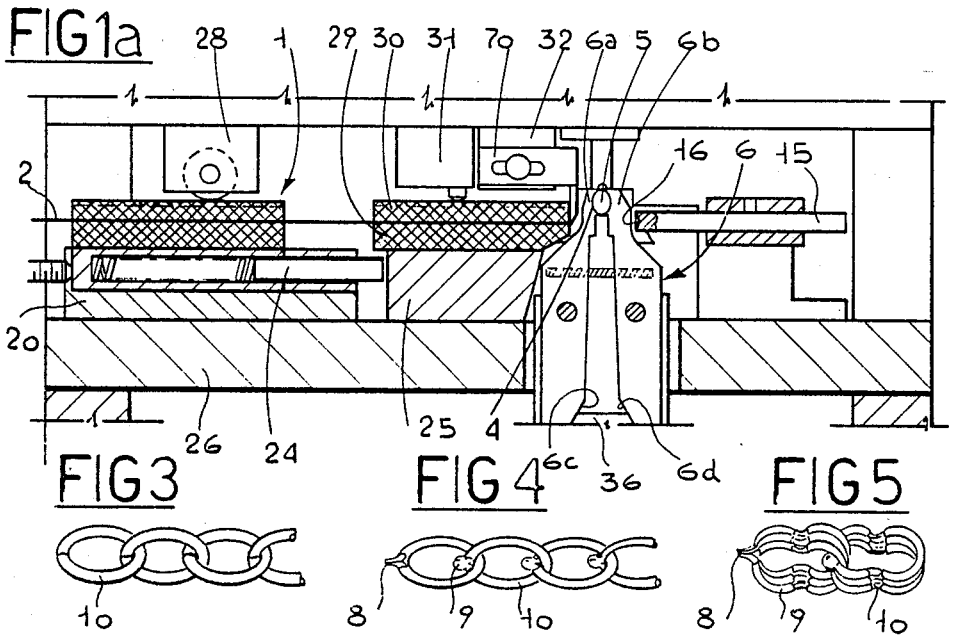
FIG1a
28
1
29
30
31
70
32
6a
5
6b
16
6
15
2
20
26
24
25
4
6c
36
6d
FIG3
FIG4
FIG5
10
8
9
10
8
9
10

APPARATUS FOR THE FORMATION OF ORNAMENTAL CHAINS

This application is a divisional of application Ser. No. 157,092 filed on Feb. 9, 1988 now abandoned which was a continuation of application Ser. No. 809,899 filed on Dec. 17, 1985 now abandoned.

BACKGROUND OF THE INVENTION

The invention relates to a machine for the formation of ornamental chains, from precious metals, and to those employed in the manufacture of costume jewelry; more specifically chains of the type known as rolo in the Italian trade.

The prior art in jewelry manufacture embraces a number of machines capable of crafting a wire from which chains are ultimately produced.

One such machine winds wire around a link former into a helicoid that is cut into discrete lengths the shape of which resembles an open link; the open links are then closed by joining up the ends, and connected one with the next in sequence.

Another type of machine, which is used in the manufacture of rolo chain, first cuts the wire into discrete lengths, then forms the links and connects them one with the next. Such a machine consists substantially of a link former, a pincer positioned beneath the former, and a die above the link former wherein the pincer and die are aligned vertically one with the other, at opposite sides of the link former, and with the link former itself.

The wire, indexed between the former (above) and the open pincer (below), is held fast by a clamp mechanism during operation of a cutter. The cutter is positioned alongside the clamp mechanism, and severs the wire into discrete lengths striking in the opposite direction to the approach of the pincer while the wire is held in position by direct contact with the pincer and the former on one side of the cut, as well as by a retainer located alongside the pincer on the other. The pincer rises and draws together, wrapping the length of wire around the bottom of the former, whereupon the die descends and bends the ends of the length of wire together over the top of the former, thus creating the link. The pincer is distanced by traversing parallel with its own axis, then turned through 90° and lowered as the wire is indexed so as to pass through the previously former link, following which the pincer opens, allowing the former link to drop onto the wire and hang, before turning through 90° once again, this time in the opposite direction, in readiness for formation of a fresh link.

The chain, growing link by link, descends through an axial bore in the pincer, and is taken up by a station downstream which solders together the ends of each link.

A machine thus embodied is of proven effectiveness as regards formation of a chain in a faultless manner, but exhibits numerous attendant drawbacks of a nature that compromise practical expediency.

First, the chain must be taken up afresh in order to solder together the ends of each link, with the result that considerable time is wasted, and the finished join not always as accurate as requirements dictate.

Second, the machine is particularly lacking in flexibility since, while it is true that machines of the type permit forming of chain links, the actual shapes obtainable exhibit but little variety from one link to another.

Accordingly, the object of the invention disclosed herein is that of overcoming such drawbacks.

SUMMARY OF THE INVENTION

The problem of embodying a machine such as will permit manufacture of rolo chain in a truly efficient and versatile manner, is solved by the invention as described hereinbelow.

Advantages obtained with the invention consist essentially in the fact that the machine as disclosed herein joins the ends of discrete lengths of wire, once cut and formed into links, automatically, swiftly, and without the chain being released and taken up a second time.

A further advantage is that the shape of the formed links can be many and various, as the conditions in which the former and the prehensile elements of the pincer operate in shaping the links are much less restrictive than those of prior art machines. For instance, no possibility exists in the prior art machines of creating links with a degree of concavity through the diametral horizontal plane of the former.

Another advantage of the invention is that it affords the possibility of shaping a discrete length of wire the longitudinal dimension of which exceeds the peripheral dimension of the former, and fusing together the stretched portions of excess length of each link into a bead; thus one is provided with a decorative feature that embellishes the finished chain.

Yet another advantage of the machine to which the invention relates is its capacity of working on more than one longitudinal member simultaneously, in such a way as to produce several links, say, of different color, in one operation.

The ability of the machine to fuse together stretched portions of excess length of each link utilizing the pincer signifies that it becomes possible to overcome one of the stumbling blocks in jewelcraft, namely, that of soldering white gold. With the technique disclosed, the ends of discrete lengths of wire in white gold are fused together rather than being soldered, with the result that one by-passes the many problems associated with soldering such a metal.

In a machine according to the present invention, the top die does not serve to shape the wire around the former, but is used to advantage in drawing together the stretched portion of excess length of each link, inasmuch as the beads produced by fusion of such stretched portions will be of uniform, regularly repeated shape.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 is a front view of the machine disclosed herein, certain parts of which are seen in section;

FIG. 1*a* is a detail of the front view of FIG. 1 drawn in larger scale, likewise with certain parts seen in section;

FIGS. 3, 4 and 5 illustrate examples of chain that can be produced by a machine according to the present invention.

DESCRIPTION OF THE PREFERRED EMBODIMENT

Figure 2B:
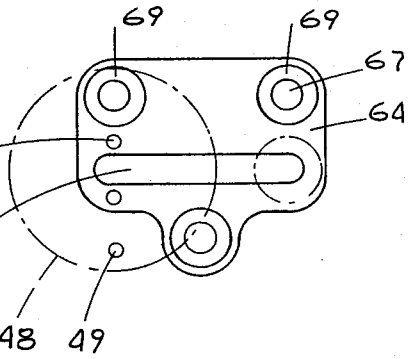
FIG. 2*b* is the plan of view of the detail of FIG. 2.
Figure 2A:
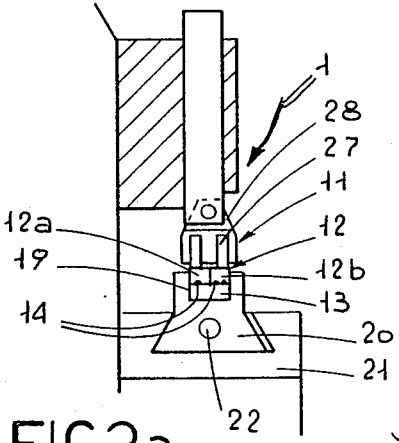
FIG. 2*a* is the side view of the detail of FIG. 1 drawn in larger scale.
Figure 2:
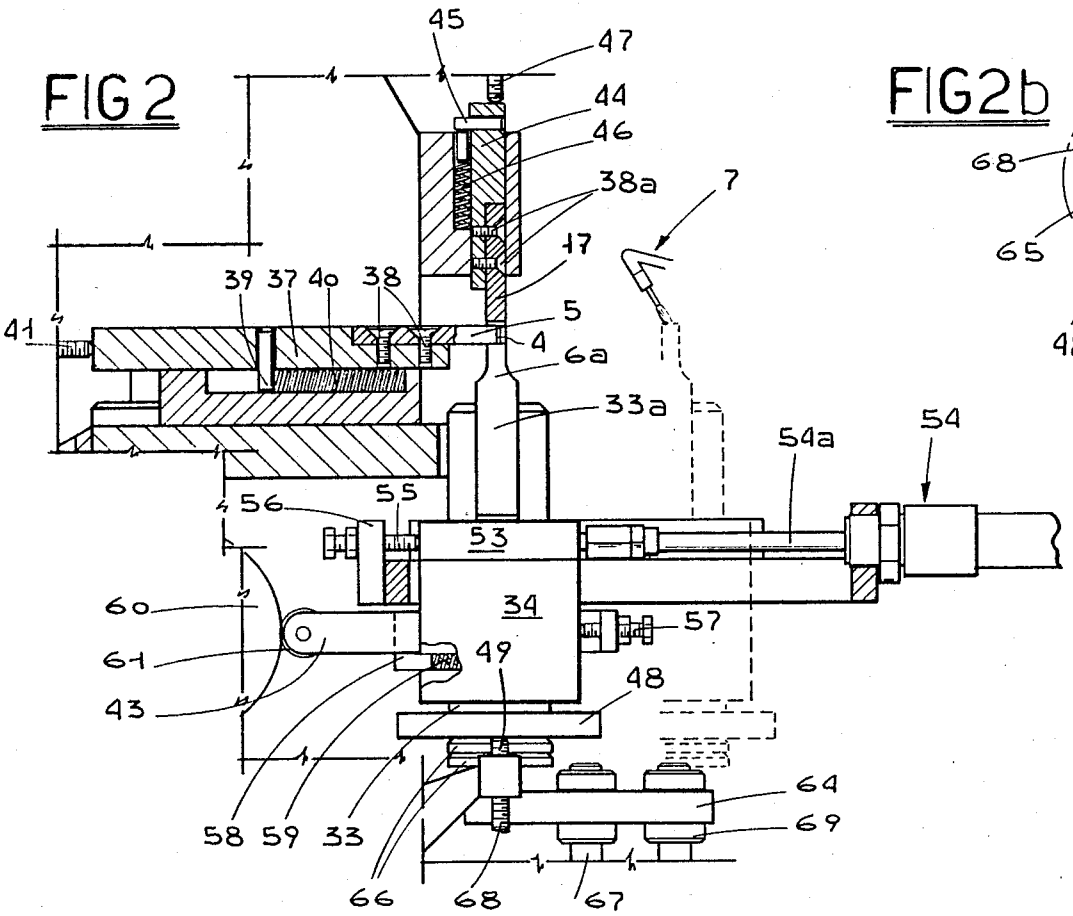
FIG. 2 is a side view of the machine as shown in FIG. 1 with certain parts omitted to better reveal others.

FIGS. 1 and 2 illustrate a machine for the manufacture of so-called rolo chain. The machine comprises a wire indexing mechanism 1 which feeds a longitudinal member, or wire 2 intermittently into the machine off a conventional supply reel; the mechanism, denoted by 1, is referred to hereinafter as the indexer.

Clamp mechanism 18 serves to hold the wire 2 fast both during return of the indexer 1, and at the moment in which the wire 2 itself is severed by a cutter 3 into discrete lengths 4. A horizontally disposed link former 5 is set at right angles to the line of movement of the indexer 1, and above the wire 2. Directly beneath the former 5 is vertically disposed pincer 6, and directly above, a die 17 aligned vertically with the pincer 6.

The indexer 1 (see FIG. 2*a*) is of a type that has a block 13 at bottom, a retainer 12 positioned above the block, and a presser 11 which bears down on the retainer 12 so as to urge it into contact with the block 13 against a bias spring (not illustrated) located between the block 13 and the retainer 12. The block 13 and the retainer 12 are located in a seat 19 offered by the top of a shoe 20 slidable in a track 21, and are inhibited thus from horizontal movement. The bottom of the retainer 12 exhibits at least one longitudinal groove 14 designed to guide and grip the wire 2 in concert with the block 13. The shoe 20 is engaged at one end by a first actuator 22 operated by synchronized means of control (not illustrated in the drawings) with which the machine is provided, and designed to propel the shoe 20 through the indexing stroke. The remaining end of the shoe engages with a spring 23 accommodated in a seat in the shoe 20 itself, disposed coaxially with the first actuator 22 and loaded against a pin 24 (FIG. 2) which slides axially in the seat and locates against a base 25 integral with the main frame 26 of the machine. The presser 11 comprises a wheel 27 that rides the retainer 12, and a second actuator 28 which carries the wheel 27 and is operated by the aforementioned synchronized means of control.

The embodiment of the clamp mechanism 18 is similar to that of the indexer 1, with a block 29, a retainer 30, and a presser 31. The difference in this instance is that the block 29 is integral with the base 25 and the presser 31 has no wheels in contact with the retainer 30. Similarly to the indexer, the retainer 30 and the block 29 of the clamp mechanism 18 incorporate a spring bias (not illustrated) and the presser 31 is operated by the machine's synchronized means of control.

The cutter consists of a vertically disposed blade 3 that strikes directly against the top edge of the clamp mechanism 18 and is carried by a support 32 operated by the same aforesaid synchronized means of control.

With reference to FIG. 2, the former 5 is made integral with a horizontal mounting 37, say, by means of bolts 38, which slides axially within the frame 26 of the machine and is provided with a vertically disposed locator 39 against which a spring 40 is loaded; the opposite end of the spring is seated against the frame 26 of the machine. This mounting 37 is engaged by a third actuator 41, likewise operated by the synchronized means of control.

The pincer 6 consists of two prehensile elements, or grips 6*a* and 6*b* accommodated by a seat 33*a* incorporated into the top of a vertical shaft 33 that is slidable axially within a sleeve 34 integral with the frame 26 of the machine. The grips 6*a* and 6*b* are pivoted at an intermediate point along their length, tensioned by a pair of springs 35 located above the pivot axis, and engaged by thrust means 36 located below the pivot axis; such thrust means is arranged within a bore provided in the shaft 33, and operated by the synchronized means of control. The ends of the two springs 35 are lodged in opposed seats offered by the grips 6*a* and 6*b* and biased against the action of the thrust means 36, the effect of which is to draw the grips 6*a* and 6*b* together and close the pincer 6. The shaft 33 is provided with gear teeth 42 that engage longitudinally and slidably with a rack 43 in such a way that the pincer 6 can be rotated through 90° about its own axis in either direction. The rack is operated by the machine's synchronized means of control. The shaft 33 incorporates a flange 48 at its bottom end, the underside of which is engaged by a fifth actuator 49 operated by the synchronized means of control, and the top side of which is subject to the action of a spring 50 accommodated in a longitudinal seat in the sleeve 34 and biased against operation of the fifth actuator 49. This fifth actuator 49 produces a movement whereby the pincer 6 is shifted from a first limit position, below the wire 2, to a second limit position, higher than the first. A setscrew 51 passes through the flange 48 at a point diametrically opposite to where the bias spring 50 is seated; the tip of this screw makes contact with the bottom end of the sleeve 34; and establishes maximum upward travel of the shaft 33.

The die 17 is positioned above the former 5 and made integral, by way of bolts 38*a* for instance, (see FIG. 2) with a vertical mounting 44 carried by the frame 26 and axially movable in relation thereto. The mounting 44 is provided with a locator 45 engaged by a spring 46 the opposite end of which is seated against the frame 26 of the machine; this spring 46 works against the action of a fourth actuator 47 that impinges on the mounting 44 axially and is operated by the machine's synchronized means of control.

In the machine according to the present invention, the grips 6*a* and 6*b* of the pincer 6 (see FIG. 1) exhibit an internal profile that matches a portion of the periphery of the former 5 in order to permit shaping of portions of the discrete lengths 4 of wire 2 therearound. Those surfaces of the grips 6*a* and 6*b* which engage with the surface of the former 5 are provided with one or more grooves (not illustrated) for the purpose of guiding portions of the lengths 4 of wire 2 during their formation into links.

Seen in section, the external profile of the sleeve 34 in the machine disclosed is substantially quadrangular; the sleeve extends downward vertically from a horizontal slide 52 supported by a shelf 26*a* integral with the frame 26 of the machine and guided in its movement by fixed ways 53, one at either side. It will be observed that one end of the rod 54*a* of a fluid power cylinder 54 is attached to the slide 52 (see FIG. 2) and the cylinder itself is mounted to the frame 26 of the machine, parallel with the longitudinal axis of the slide 52. When thrust horizontally by the rod 54*a* of the cylinder 54, the slide 52 locates against the tip of a setscrew type limiter 55 that is fitted to a bracket 56 integral with the frame 26 of the machine, and adjustable thus for axial position.

The rack 43, accommodated in a seat offered by the sleeve 34 and axially slidable therein, has one end (that lying below the cylinder rod 54*a*) bent 90° toward the sleeve 34, creating an appendage in which a setscrew limiter 57 is positioned with its tip designed to locate against the sleeve itself. An L-shaped pin 58 one leg of which passes through the rack 43 transversely at an intermediate point along its length, the remaining leg of the L being axially slidable in a seat that accommodates a spring 59 biased so as to keep the limiter 57 in contact with the sleeve 34. A sixth actuator takes the form of a cam 60 (see FIG. 2), and engages the remaining end of the rack 43 by way of a follower 61 fitted idle to the end in question.

Thrust means 36 for operation of the pincer 6 takes the form of a hollow rod accommodated slidably within the bore of the shaft 33. The external surface of the hollow rod 36 exhibits two regions of dissimilar diameter separated by an upwardly directed shoulder on which seats one end of a coil spring 62 surrounding the region of the hollow rod 36 with the smaller diameter. The remaining end of the spring 62 is seated against a shoulder created by a reduction in the bore of the shaft 33. The uppermost end of the hollow rod 36 is slightly rounded, and makes contact with angled surfaces 6*c* and 6*d* offered by the bottom ends of the respective pincer grips 6*a* and 6*b*. The bottom end of the rod 36 is externally threaded, and passes clean through the flange 48 of the shaft 33. This same end of the hollow rod 36 is provided with a pair of longitudinally disposed pins 63 having ball ends that ride on a plate 64, one either side of a slot 65 in the plate itself. Two locknut limiters 66 are screwed onto the threaded part of this end of the hollow rod 36, for reasons that will become apparent. Three posts 67 are integral with the frame 26 of the machine. The plate 64 is positioned with its slot 65 parallel to the rod 54*a* of the cylinder 54, and accommodates the three posts 67 by way of respective collars, two of which are at one side of the slot 65, the third at the other side, as illustrated in FIG. 2. The plate 64 itself is carried by a seventh actuator, in this case, a pair of vertical actuators 68 impinging on the bottom face of the plate 64 at either side of the slot 65.

The retainer 12 forming part of the indexer 1 is split lengthwise into two half-sections 12*a* and 12*b* (see FIG. 2*a*) exhibiting one and two longitudinal grooves 14, respectively. Accordingly, the presser 11 has two wheels 27, each of which urges against a respective half-section 12*a* and 12*b* of the retainer 12. Either one of the wheels 27 may be removed without affecting operation of the indexer 1, which can feed one only, or two, or even three wires 2.

It will be seen in FIG. 2 that the machine is provided with soldering means 7; such means is located at the position which is assumed by the pincer 6 with the rod 54*a* fully retracted into the cylinder 54 and is operated by the machine's synchronized means of control (not shown).

The bottom surface of the die 17 is provided with a single tapered recess (not shown) the reason for which will become apparent in due course.

In a machine according to the present invention, the block 29 of the clamp mechanism 18 is made fast to its base 25, while remaining adjustable in relation thereto through the path of the wire 2.

Similarly, the cutter blade 3 is made fast to its support 32 in adjustable fashion so as to remain positionable along the path of the wire 2. FIGS. 1 and 1*a* illustrate the blade 3 being integral with a plate 70, arranged at right angles thereto and locked fast by a clamp screw 71 that passes through a slot 72, located in the plate itself and parallel with the wire 2, and engages a thread in the support 32.

Support 15 carried by the machine frame 26 and extending coaxially from the end of the wire 2, which is provided with a tapered recess 16. The support 15 serves to accommodate the leading end of the wire 2. The support 15 is adjustable axially in relation to the frame 26.

The actuators 22, 28, 41, 47, 49 and 68, the presser 31, the blade support 32 and the cam 60 are all operated by a synchronized drive system (not illustrated in the drawings) which might comprise cams keyed to a main shaft, and driven linkages.

OPERATION OF THE APPARATUS OF THE PRESENT INVENTION

Assuming it is wished to obtain links similar to those illustrated in FIG. 3—i.e. oval with butted ends, the machine is set up by adjusting the position of the block 29 in relation to its base 25 and of the support 15 in relation to the block 29, such that the central point of the discrete lengths 4 of wire cut by the blade will locate against bottom dead center of the link former 5. The blade 3 must be positioned in order to strike correctly in relation to the top corner of the block 29 of the clamp mechanism 18, and the stroke of the indexer 1 adjusted to match the cut length 4 of wire 2. The wheel 27 that rides the half-section 12*b* of the indexer block with the two longitudinal grooves 14 is removed, and the link former 5 and grips 6*a* and 6*b* having the appropriate oval shape are fitted.

With the machine running, the indexer 1 is shifted by the first actuator 22 and feeds the wire 2 at each stroke through a distance equal to the cut length 4. When indexed, the wire 2 passes beneath the level of the link former 5, which at that particular moment is moved away, against its bias spring 40, by the third actuator 41; the wire 2 duly locates in the tapered recess 16 offered by the support 15, and is locked thus by the clamp mechanism 18 under the force of the presser 31. In preparation for the moment in which the cutter support 32 descends with the blade 3 so as to sever a length 4 from the wire 2, the third actuator 41 moves the former 5 into position, and the fifth actuator 49 raises the pincer 6, which will at this stage be held open by its springs 35. Thus, the wire 2 is not severed until the length 4 to be cut is clamped from below and above between the pincer grips 6*a* and 6*b*, and the former 5.

The pincer 6 is now raised fully to the point where the setscrew 51 locates against the sleeve 34, and at the same time, the seventh actuators 68 begin raising the plate 64, and with it, the hollow rod 36, which gradually closes the pincer by urging together the two grips 6*a* and 6*b* bringing the upper of the two locknuts 66 into contact with the shaft flange 48 as in FIG. 1. With the pincer 6 fully closed, likewise as in FIG. 1, the length 4 of wire assumes the shape of a link 10 as in FIG. 3, with ends butted together. The die 17 is not utilized in this instance, since the grips 6a and 6b are of internal shape such as can loop the length 4 of wire into fully formed link 10. The former 5 is moved away by the third actuator 41 and the cylinder 54 retracts, drawing back the slide 52 complete with pincer 6 and link 10 so as to distance the link from the former 5 and bring it toward the soldering means 7 (see broken outline of FIG. 2). The pincer 6 remains closed during traverse of the slide 52 since the raised position of the plate 64, which is maintained by the seventh actuators 68, prevents the hollow rod 36 from descending; similarly, the uppermost locknut 66 remains in contact with the flange 48, so that the shaft 33 and pincer 6 are kept in a raised position. With soldering of the butted ends of the link 10 completed, using an additional medium if necessary, the cylinder 54 is extended through the return stroke to the position illustrated in regular line in FIG. 2. The cam-follower 61 carried at the end of the rack 43 thus relocates against the cam 60. The rack 43 will not have moved in relation to the sleeve 34 during traverse of the slide 52, as the action of its spring 59 is offset by location of the setscrew 57 against the sleeve itself. The cam 60 however, which is in continuous rotation, now offers the follower 61 that part of its profile which projects farthest from the drive shaft, thereby shifting the rack 43 and producing rotation of the shaft 33, hence of the pincer 6. The position of the indexer 1 is reset in relation to the wire 2 during the above sequence of operations, the wire being freed through the operation of the second actuator 28 whereby the retainer 12 is allowed to rise clear of the block 13. With the indexer 1 at its backward limit, the second actuator 28 causes the retainer 12 to descend, whereupon the presser 31 at the clamp mechanism 18 allows the clamp retainer 30 to rise and release the wire 1, now held fast by the indexer 1. Thus, the indexer 1 departs on its work stroke toward the link former 5 with the pincer 6 and the previously formed link 10 turned through 90° by the rack, and in its approach toward the support 15, the wire 2 passes through the link 10. Only when the leading end of the wire 2 has located and lodged in the tapered recess 16 of the support 15 will the seventh actuators 68 be lowered and allow the hollow rod 36 to descend; the pincer 6 thus descends likewise, to the point where the flange 48 of the vertical shaft 33 locates against the fifth actuator 49, and the grips are spread by the action of the springs 35. The link 10 descends together with the pincer 6 and, being no longer held thereby, drops and hangs on the wire 2 newly suspended between the clamp mechanism 18 and the support 15. The rack 43 is now returned to its original position as illustrated in the drawings, biased thereinto by the spring 59 now that the cam 60 no longer impinges on its end, with the result that the pincer 6 turns back through 90° to regain the initial position which, likewise, is that illustrated in the drawings.

The former 5 now moves into its work position as before, and the cycle repeats in the same way as described above, with the chain forming link by link and descending through the axial bore of the shaft 33 and the hollow rod 36, and finally, through the slot 65 in the plate 64 at bottom.

In the event that two links 10 are to be produced in side-by-side formation, per cycle, then the wheel 27 riding the twin-grooved half-section 12b of the index retainer 12 will be replaced, and the wheel of the other half-section 12a removed; likewise, the grips 6a and 6b will be replaced by a pair having two internal grooves (not illustrated).

Where the link 10 to be formed is envisaged in triple side-by-side formation (as per the example of FIG. 5), both wheels 27 must operate, and the grips 6a and 6b will have three grooves (not illustrated).

Where it is wished to produce links 10 of the types shown in FIGS. 4 and 5, the indexer 1 must be set to feed the appropriate length of wire by adjusting the first actuator 22, the clamp mechanism 18 and support 15 spread apart correspondingly, and the two grips 6a and 6b replaced. The clamp mechanism 18 and the support 15 must be distanced by an equal amount every time an adjustment is made, such that the midpoint of the length 4 of wire will fall into vertical alignment with the axis of the link former 5. In this instance, the grips 6a and 6b must leave a wider gap (not illustrated) when the pincer 6 is closed, such as will admit and accomodate the ends of the looped length 4 of wire. Needless to say, the cutter blade 3 must also be adjusted to match the changed position of the clamp mechanism 18. When producing links by this method, it will be advisable to utilize a wire 2 having stretch portions 8 of reduced diameter (see FIG. 4) at regular intervals in order to avoid the formation of beads 9 exhibiting overlarge proportions in relation to the link 10. Clearly, the wire 2 will need to be cut into lengths 4 by severance of the stretched portions 8 of reduced diameter at mid-point. The ideal shape of the stretched portions 8 of reduced diameter is that of an opposed pair of outwardly splaying cone frusta, which when cut will create discrete lengths 4 the ends of which appear as single cone frusta.

Operation of the machine in this case differs substantially in two respects: first, with the pincer 6 closed and the length of wire formed into a link, the die 17 decends and presses the cone frustra ends 8 of the length 4 of wire into tight contact. Second, the soldering means 7 unites the ends of the stretched portions 8 of wire, not by application of an additional medium, but by fusing together the ends theselves.

Clearly, the link former 5, and therefore the grips 6a and 6b, can be embodied in any given shape, provided that no re-entrant profiles are incorporated such as inhibit spread of the pincer 6.

Similarly, the wire 2 itself may exhibit a constant section or otherwise, or alternatively, may be provided with embellishments (as in FIG. 5).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for forming an ornamental chain from at least one wire, said method comprising the steps of intermittently feeding said wire by feeding means, positioning said wire along a link former having a transverse predetermined peripheral length substantially equal to the perimeter of a finished link, supporting the leading end of the wire by support means positioned, with respect to a cutting means, at a linear distance longer than said transverse predetermined length of said link former and than said perimeter of each link, cutting said wire into discrete lengths of a predetermined length and having two ends by said cutting means, closing a pincer positioned adjacent said link former in a first position, bending, by the closing of said pincer, each of said discrete lengths of wire so that the two ends of each of said discrete lengths become bent up, moving downwardly die means located above said link former, receiving said two ends in a substantially tapered recess at the lower end of said die means, said recess having a peripheral length which exceeds said transverse predetermined peripheral length of the link former, pressing tightly together in a substantially parallel configuration said two ends of the link positioned around the link former, maintaining said pincer closed during passage of said pincer from its first position to a second position adjacent to heating means, and fusing by the heating means the two parallel ends together to form a bead that constitutes an embellishment of the finished link.

2. A method for the formation of an ornamental chain from at least one wire comprising the following steps intermittently feeding a wire having stretch portions into a link former having a transverse predetermined peripheral length, cutting said wire by cutting means into discrete lengths greater than the dimension of a finished link or the transverse predetermined peripheral length of said link former longitudinally shaping each length around said link former by a pincer cooperating with the link former, said shaping including disposing excess lengths of said stretch portions parallel and on the same side of said link former, pressing into tight contact said excess lengths of said stretch portions by movable die means located above said link former, before and during a heating phase, and fusing during said heating phase said excess lengths to form an embellishment of the finished link.

* * * * *